United States Patent [19]

Ichisaka et al.

[11] 4,116,805

[45] Sep. 26, 1978

[54] BIPOLAR ELECTRODE

[75] Inventors: Teruo Ichisaka; Tadao Ikegami, both of Tamano, Japan

[73] Assignee: Chlorine Engineers Corp., Ltd., Tokyo, Japan

[21] Appl. No.: 878,100

[22] Filed: Feb. 15, 1978

[30] Foreign Application Priority Data

Feb. 17, 1977 [JP] Japan ..... 52-15501

[51] Int. Cl.[2] ..... C25B 11/00

[52] U.S. Cl. ..... 204/290 F; 204/254; 204/268

[58] Field of Search ..... 204/290 F, 290 G, 290 R, 204/291-293, 254, 255, 268, 256; 429/210

[56] References Cited

U.S. PATENT DOCUMENTS

| | | | |
|---|---|---|---|
| 3,844,921 | 10/1974 | Benedict | 204/290 F X |
| 3,859,197 | 1/1975 | Bourg | 204/284 |
| 3,875,042 | 4/1975 | Grunig | 204/290 F |
| 3,915,833 | 10/1975 | Michalek | 204/254 |
| 3,970,539 | 7/1976 | Collins et al. | 204/254 |
| 4,017,375 | 4/1977 | Pohto | 204/255 |
| 4,059,216 | 11/1977 | Meyer | 204/256 X |

*Primary Examiner*—Charles F. Lefevour
*Attorney, Agent, or Firm*—Sughrue, Rothwell, Mion, Zinn and Macpeak

[57] ABSTRACT

A bipolar electrode comprising a. an anode member comprising a substrate made of an anticorrosive metal or metal alloy and an electrically conductive coating formed on the surface thereof;

b. a cathode member comprising a metal or a metal alloy;

c. a partition wall for separating the anode member from the cathode member, the partition wall comprising an anode-side sheet made of the same type of anticorrosive metal or metal alloy used as the substrate of the anode member and a cathode-side sheet made of the same type of metal or metal alloy used as the cathode member; and d. a composite member for electrically and structurally connecting the anode member and the cathode member to each other.

4 Claims, 5 Drawing Figures

BIPOLAR ELECTRODE

BACKGROUND OF THE INVENTION

1. Field of the Invention

This invention relates to a bipolar electrode which comprises an anode member and a cathode member separated from each other by a partition wall and electrically and structurally connected to each other, and which is suitable for electrolyzing an aqueous solution of an alkali metal chloride, etc., for the production of alkali metal chlorates, or alkali metal hydroxides and chlorine.

2. Description of the Prior Art

A conventional bipolar electrode is disclosed in U.S. Pat. No. 3,859,197 and has the structure shown in FIG. 1. In FIG. 1, reference numeral 1 represents a composite member obtained by explosive welding of titanium plate 4 and a mild steel plate 5. The composite member 1 is fitted in an opening of a partition wall 16 of a titanium sheet 2 and a mild steel sheet 3 so that the composite member forms a part of the partition wall 16. The outer edge portion of the titanium plate 4 of the composite member 1 is welded to an opening in titanium sheet 2, and the outer edge portion of the mild steel plate 5 is welded to an opening in the mild steel sheet 3.

The titanium plate 4 of the composite member 1 is welded to an anode member 7 with titanium as a substrate through a titanium spacer 6 welded to the titanium plate 4, and the mild steel plate 5 of the composite member 1 is welded to a cathode member 9 by means of a spacer 8 of mild steel welded to the mild steel plate 5. Thus, the anode member 7 and the cathode member 9 are connected electrically and structurally by the composite member 1 to form a bipolar electrode having an anode compartment 10 and a cathode compartment 11.

The anode member 7 is made of a mesh-like titanium substrate having formed thereon a coating of a platinum-group metal or a platinum-group metal oxide, and the cathode member 9 is formed in a grid shape.

The conventional bipolar electrode described above has the defect that the metal employed on the cathode-side (hereinafter "cathode-side metal") such as iron of the composite member has poor adhesion to the metal employed on the anode-side (hereinafter "anode-side metal") such as titanium and they tend to separate from each other physically, and that when the electrode is operated for long periods of time, titanium hydride forms at the joint portion of the composite member resulting in a separation of the metals of which the bipolar electrode is constructed. The reason is while metals suitable as the cathode member, such as iron or nickel, have a low hydrogen overvoltage at the cathode and easily permit permeation of hydrogen atoms, materials suitable as the anode substrate, such as titanium, readily form hydrides.

Hydrogen evolution in the electrolysis of an aqueous solution of an alkali metal chloride occurs according to the following two-stage reaction.

$$H^+ + e \rightarrow H_{(ad)} \quad (1)$$

$$H_{(ad)} + H_{(ad)} \rightarrow H_2 \uparrow \quad (2)$$

wherein $H_{(ad)}$ represents adsorbed hydrogen. It is known that reaction (2) determines the rate of the entire reaction. For this reason, the surface of iron which is a cathode-side metal of the composite member is always filled with $H_{(ad)}$, a part of which permeates through the iron and finally reaches the portion of the composite member where the metals are joined. At this portion, the hydrogen reacts with the titanium used as the anode-side metal to form physically brittle titanium hydride and thus cause a breakage of the portion where the metals are joined to occur. Consequently, the metals are electrically insulated from each other, and the voltage between both surfaces of the composite member increases until finally the electrode becomes useless. The time which elapses until this phenomenon occurs varies depending on the current density at the portion where the metals are joined and the thickness of the cathode-side metal. For example, a composite material composed of iron having a thickness of 10 mm and titanium which are explosion-welded to each other will become useless in 1.5 to 3 years when used at a current density of 200 A/dm$^2$.

A bipolar electrode of the type shown in FIG. 2 was devised in an attempt to remove the defects described above. A composite member 12 comprises an anode-side portion 13 made of a metal such as titanium or a titanium alloy used as a substrate of an anode member 7 and a cathode-side portion 15 made of a metal such as mild steel or an alloy of mild steel used as a base of a cathode member 9, with the portions 13 and 15 being bonded to each other with an interlayer portion 14 made of copper or a copper alloy such as brass therebetween. The portions 13, 14 and 15 are formed in a plate shape, and bonded using an explosive welding method or a frictional welding method. The portion 14 as an interlayer of the composite member 12 may be composed of two or more laminated layers.

The composite member 12 is fitted in an opening of a partition wall 16 so as to form a part of the partition wall 16. Stated more specifically, the outer edge portion of the portion 13 of the composite member 12 is welded to an opening portion of a sheet 2 of the partition wall 16, and the outer edge portion of the portion 15 is welded to an opening portion of a sheet 3. When the composite member 12 is made a part of the partition wall 16, the portion 14 made of copper or a copper alloy which becomes an interlayer of the composite member 12 needs to be formed such that it will not be exposed to the electrolyte solution.

With such a structure, the copper or copper alloy portion used as an interlayer of the composite member does not permit the permeation of hydrogen, and, therefore, hydrogen which is generated on the cathode side during electrolysis does not reach the joint surface between the interlayer and the portion made of titanium. Hence, the portion made of titanium does not separate from the portion made of copper or copper alloy at the surface thereof which is bonded. On the other hand, the portion made of mild steel has very good adhesion to the portion made of copper or copper alloy, and the portion made of copper or copper alloy does not easily form a hydride. Accordingly, the portion made of mild steel does not tend to separate from the portion made of copper or copper alloy at the surface thereof which is bonded.

However, since in the structure shown in FIG. 2, the portions 13, 14 and 15 of the composite member are bonded together by only a surface-to-surface bond, the surface-to-surface bond tends to be destroyed by mechanical factors or under severe electrolyzing conditions. Furthermore, since in the above structure the opening portion of the mild steel sheet 3 of the partition wall 16 is welded to the outer edge portion of the mild steel portion 15 of the composite member 12 so that the composite member 12 is fitted in the opening of the partition wall 16 to form part of the partition wall 16, the mild steel portion 15 after welding has no tolerance to heat deformation. Consequently, cracks occur in the welded part due to stress, or this structure tends to cause cracks to occur at the welded part due to temperature changes during electrolysis. Moreover, when cracks are present at the welded part of the portion 15 and the sheet 3, the cracks increase during electrolysis, and the catholyte solution penetrates through the cracks. This causes a destruction of the joint part of the composite member 12, and the portion 14 made of copper or a copper alloy as an interlayer of the composite member 12 is corroded. Thus, an electrically insulated condition is generated within the composite member to induce an increase in voltage.

U.S. Pat. No. 3,884,792 also discloses a bipolar electrode structure which includes an anode, a layer of an atomic hydrogen permeable base material between the anode and a cathode and a layer of a metal or a metal alloy as an interlayer which is resistant to the flow of atomic hydrogen. From the description in this U.S. patent, capped tungsten screws are used in order to secure the anode and cathode to the core, bolts typically constructed of mild steel are used for securing each pair of cathode plates, or connectors typically constructed of copper are used as electrical connectors. Therefore, this U.S. patent has the same disadvantages as set forth above and corrosion along the tungsten-capped screws tends to occur when such are used.

SUMMARY OF THE INVENTION

An object of this invention is to provide a bipolar electrode which is free from the defects described above and can be operated in a stable manner over long periods of time.

The object of this invention is achieved by a bipolar electrode comprising a. an anode member composed of a substrate made of an anticorrosive material, such as a valve metal or a valve metal-base alloy, and a conductive coating formed on the surface thereof, b. a cathode member, e.g., made of mild steel, nickel or the like, c. a partition wall for separating the anode member from the cathode member which is composed of an anode-side sheet made of the same type of metal or alloy used as the substrate of the anode member and a cathode-side sheet made of the same type of metal or alloy used as the cathode member, and d. a composite member for electrically and structurally connecting the anode member and the cathode member to each other comprising an anode-side portion made of the same type of metal or alloy used as the substrate of the anode member, a cathode-side portion made of the same type of metal or alloy used as the cathode member, and, as an interlayer, a portion made of an electrically conductive metal or alloy, such as copper or a copper alloy, which is resistant to the migration of hydrogen and is substantially impermeable to atomic hydrogen, these three portions being bonded to each other; wherein (1) pins made of an electrically conductive metal or an alloy of an electrically conductive metal, such as copper or an alloy of copper, which is resistant to the migration of hydrogen and is substantially impermeable to atomic hydrogen are caulk-fitted in through-holes provided in the composite member and diverging toward both surfaces of the composite member like a funnel so that the pins adhere closely to the inside surfaces of the through-holes, (2) the anode-side sheet and the cathode-side sheet of the partition wall are sheets having no through-hole for inserting the composite member, (3) the cathode-side portion of the composite member is welded to the surface of the inside of the cathode-side sheet of the partition wall in a superimposed state, and (4) the surface of the anode-side sheet is bonded by resistance welding to the top surface of the anode-side portion of the composite member in a superimposed state.

DESCRIPTION OF THE PREFERRED EMBODIMENTS

Figure 1:
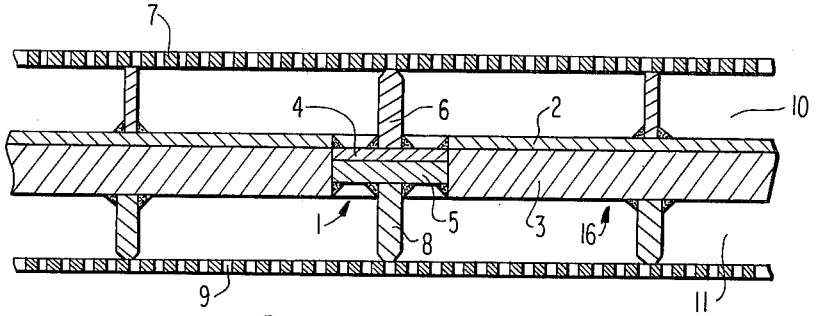
FIGS. 1 and 2 are cross-sectional views of bipolar electrodes disclosed in the prior art.
Figure 2:
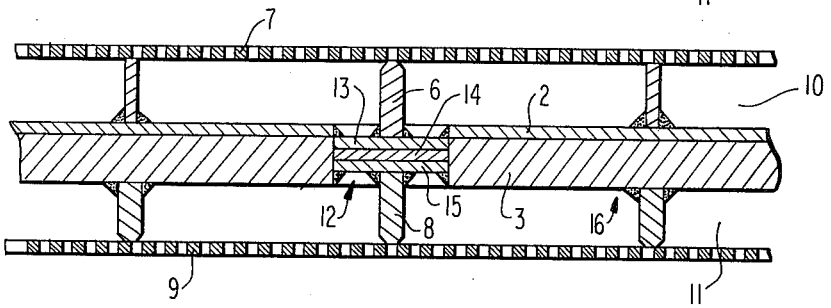
Figure 3A:
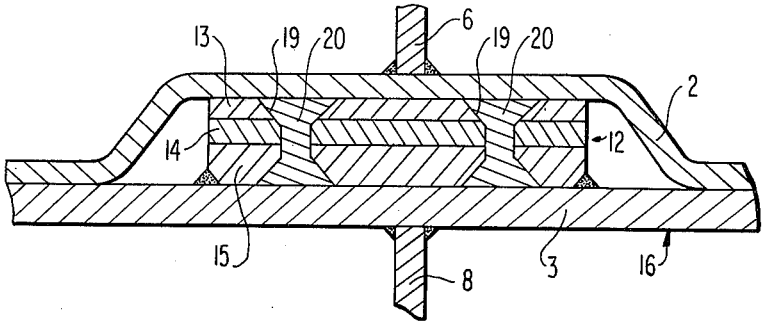
FIGS. 3(*a*) and (*b*) are an enlarged cross-sectional view of the bipolar electrode of this invention.
Figure 3B:
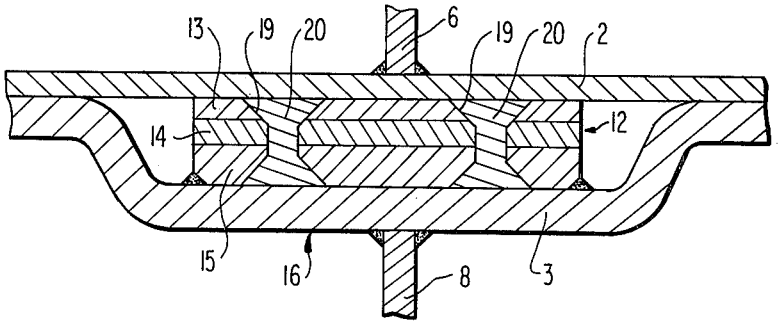

One embodiment of the present invention is shown in FIG. 3(*a*) which is an enlarged view of the bonded part of the partition wall and the composite member in the bipolar electrode. In FIG. 3, 2 is an anode-side sheet, 3 is a cathode-side sheet, 6 is a spacer and 8 is a spacer, and in FIG. 3(*a*), the composite member is shown by reference numeral 12, and is a mutually bonded structure comprising an anode-side portion 13 made of a metal or a metal alloy such as titanium or a titanium alloy used as the substrate of the anode member, a cathode-side portion 15 made of a metal such as mild steel or a metal alloy used as the cathode member, and an interlayer portion 14 made of copper or an alloy of copper disposed between the portions 13 and 15. The portions 13, 14 and 15 may be formed into plates of various shapes such as a circular shape, an elliptical shape or a rectangular shape, and are bonded by an explosive welding method or a friction welding method. The composite member 12 includes through-holes 19 which diverge toward both of the surfaces like a funnel. A pin 20 made of an electrically conductive metal or an alloy of an electrically conductive metal, such as copper or a copper alloy (e.g., brass) which is resistant to the migration of hydrogen and is substantially impermeable to atomic hydrogen is fitted by caulking in each of the through-holes 19.

In FIG. 3(*a*), the composite member 12 is bonded on the cathode-side sheet 3 of a flat plate, however, as shown in FIG. 3(*b*), the composite member 12 can be bonded between the anode-side sheet 2 of a flat plate and the cathode-side sheet 3 which is formed as a curved surface since the cathode-side sheet, commonly made of mild steel which is more pliable, is more easily deformed.

Figure 4:
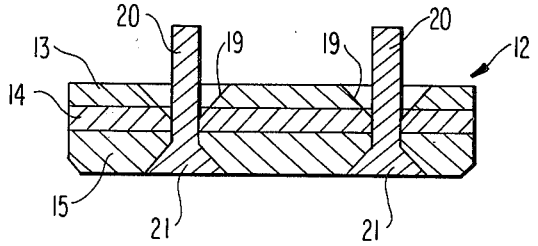
FIG. 4 shows an embodiment of forming the composite member used in the bipolar electrode of this invention.

FIG. 4 shows one embodiment of forming the composite member 12 in the present invention. Pin 20 has a larger length than through-hole 19, and is like a countersunk rivet having a head 21 at one end which diverges toward the end surface like a funnel. The pin 20 is inserted in each through-hole 19 of the composite member 12 with the head 21 turned downward, and pressed from the top and the bottom using a press device (not shown). The upper end portion of the pin 20 is thus caulk-fitted in the through-hole 19 in close adhesion. The projecting portions at the top and bottom surfaces of the pin 20 are finished by a grinder so that they become smooth and are continuous with the top and bottom surfaces of the composite member 12. In FIG. 3, the reference numeral 16 designates a partition wall which is made by superimposing an anode-side sheet 2 made of a metal such as titanium or a titanium alloy used as the substrate of the anode member on a cathode-side sheet 3 made of a metal such as mild steel or a mild steel alloy used as the cathode member. At the joint portion between the partition wall 16 and the composite member 12, the cathode-side portion 15 of the composite member 12 is superimposed on the surface of the inside of the cathode-side sheet 3 of the partition wall 16, and welded at the peripheral portion. The anode-side sheet 2 of the partition wall 16 is separated from the cathode-side sheet 3, and superimposed on the top surface of the anode-side portion 13 of the composite member 12, and they are welded by resistance welding. A spacer 6 used to connect the anode member (not shown) and a spacer 8 used to connect the cathode member (not shown) are welded respectively to the anode-side sheet 2 and the cathode-side sheet 3 of the partition wall 16.

Suitable valve metals and valve metal alloys which can be used in this invention as the anode member in the embodiments described herein include electrically conductive passivatable metals which are passivated by the formation of an inert, non-conductive layer of the oxide thereof on the surface thereof. A typical example of such a metal is titanium, but also examples include tantalum, niobium, hafnium and zirconium and alloys where one or more of these metals predominate.

In the above embodiments, suitable cathode member materials which can be used in this invention are materials which have a high electrical conductivity, which are readily available and which have adequate resistance to chemical corrosion when used as a cathode. Examples of such metals are iron, aluminum, nickel, lead, tin and zinc and alloys such as mild steel, stainless steel, bronze, brass, monel and cast iron. A (low carbon) mild steel is commonly used as the material for the cathode member.

Suitable interlayer materials which can be used in the embodiments of this invention include electrically conductive materials resistant to atomic hydrogen migration, such as copper, gold, tin, lead, nickel, cobalt, chromium, tungsten, molybdenum and cadmium. Alloys of these metals can also be used.

Exemplary materials which can be used for pins 20 in this invention include the hydrogen migration resistant materials described herein as suitable for the interlayer. Preferred materials are those which are ductile and workable, for example, copper, gold, tin, lead, nickel, cadmium and alloys thereof.

Suitable materials for spacers 6, 8 are electrically conductive materials resistant to environmental corrosion (e.g., by electrolyte and gas) in the anode and cathode compartment.

The constituent elements of the composite member of the bipolar electrode of this invention are bonded to one another by a surface-to-surface adhesion, and a pin made of an electrically conductive metal such as copper or an alloy of copper is inserted in each through-hole with funnel-shaped ends in intimate adhesion to the inside surface of the through-hole. Consequently, the mechanical strength of the composite member is increased, and the composite member does not separate even under severe conditions. Furthermore, the anode-side sheet of the partition wall is welded by resistance welding onto the top surface of the anode-side portion of the composite member. Thus, even if the surface of the pin 20 is exposed on the surface of the anode-side sheet of the partition wall, resistance welding can be easily performed without being affected by the pin because the pin has good electric conductivity.

In addition, according to the bipolar electrode of this invention, the composite member is not connected in the through-hole of the partition wall by mere insertion, but the cathode-side portion of the composite member is welded to the cathode-side sheet which has no through-hole for insertion, of the partition wall in the superimposed state. Thus, tolerance exists at the welded portion between the cathode-side portion of the composite member and the cathode-side sheet of the partition wall. Hence, cracks do not easily form due to stress during welding. Even if cracks should occur, there is no likelihood of the permeation of the catholyte solution since the welded portion between the cathode-side portion of the composite member and the cathode-side sheet of the partition wall is not exposed to the catholyte solution. For this reason, the interlayer of the composite member is not corroded, and the bonded portions of the composite member are not destroyed. The electrode can, therefore, be operated in a stable manner for long periods of time.

While the invention has been described in detail and with reference to specific embodiments thereof, it will be apparent to one skilled in the art that various changes and modifications can be made therein without departing from the spirit and scope thereof.

What is claimed is:

1. A bipolar electrode comprising a. an anode member comprising a substrate made of an anticorrosive metal or metal alloy and an electrically conductive coating formed on the surface thereof;

b. a cathode member comprising a metal or a metal alloy;

c. a partition wall for separating the anode member from the cathode member, said partition wall comprising an anode-side sheet made of the same type of anticorrosive metal or metal alloy used as the substrate of said anode member and a cathode-side sheet made of the same type of metal or metal alloy used as the cathode member; and d. a composite member for electrically and structurally connecting the anode member and the cathode member to each other, said composite member comprising bonded together (i) an anode-side portion made of the same type of anticorrosive metal or metal alloy used as the substrate of the anode member, (ii) a cathode-side portion made of the same type of metal or metal alloy used as the cathode member, and (iii), as an interlayer, a portion made of an electrically conductive metal or metal alloy, which is resistant to the migration of hydrogen and is substantially impermeable to atomic hydrogen; wherein (1) pins made of an electrically conductive metal or metal alloy, which is resistant to the migration of hydrogen and is substantially impermeable to atomic hydrogen, are caulk-fitted in through-holes provided in said composite member (*d*) and outwardly diverging toward both surfaces of the composite member (*d*) so that the pins (1) adhere closely to the inside surfaces of the through-holes in the composite member (*d*), (2) the anode-side sheet and the cathode-side sheet of the partition wall (*c*) are sheets having no through-hole for inserting the pins in the composite member, (3) the cathode-side portion of the composite member (*d*) is welded to the surface of the inside of the cathode-side sheet of the partition wall (*c*) in a superimposed state, and (4) the surface of the inside of the anode-side sheet is resistance welded to the top surface of the anode-side portion of the composite member (*d*) in a superimposed state.

2. The bipolar electrode of claim 1, wherein the substrate of said anode member is selected from the group consisting of titanium, tantalum, niobium, hafnium and zirconium or an alloy of at least one of these metals, wherein said cathode metal is selected from the group consisting of iron, aluminum, nickel, lead, tin and zinc or an alloy of at least one of these metals, wherein said interlayer is selected from the group consisting of copper, gold, tin, lead, nickel, cobalt, chromium, tungsten, molybdenum and cadmium or an alloy of at least one of these metals and wherein said pins are selected from the group consisting of copper, gold, tin, lead, nickel and cadmium or an alloy of at least one of these metals.

3. The bipolar electrode of claim 1, wherein the substrate of said anode member is a valve metal or a valve metal alloy, wherein said cathode member is selected from the group consisting of mild steel and nickel, wherein said interlayer is made of copper or a copper alloy and wherein said pins are made of copper or a copper alloy.

4. The bipolar electrode of claim 1, wherein the anode member (*a*), the cathode member (*b*), the anode-side sheet of the partition wall (*c*), the cathode-side sheet of the partition wall (*c*), the anode-side portion of the composite member (*d*), the cathode-side portion of the composite member (*d*), and the interlayer of the composite member (*d*), are made of titanium, mild steel, titanium, mild steel, titanium, mild steel, and copper, respectively.

* * * * *